US010249963B2

(12) United States Patent
Lee et al.

(10) Patent No.: US 10,249,963 B2
(45) Date of Patent: Apr. 2, 2019

(54) CONNECTOR AND BLIND MATING CONNECTOR INCLUDING THE SAME

(71) Applicant: GigaLane Co., Ltd., Hwaseong-si (KR)

(72) Inventors: Jin Uk Lee, Hwaseong-si (KR); Sang Min Seo, Hwaseong-si (KR); Hwa Yoon Song, Hwaseong-si (KR); Chang Hyun Yang, Hwaseong-si (KR); Kyung Hun Jung, Hwaseong-si (KR); Hwang Sub Koo, Hwaseong-si (KR); Hyun Je Kim, Hwaseong-si (KR); Hee seok Jung, Hwaseong-si (KR)

(73) Assignee: GIGALANE CO., LTD., Hwaseong-si (KR)

( * ) Notice: Subject to any disclaimer, the term of this patent is extended or adjusted under 35 U.S.C. 154(b) by 0 days.

(21) Appl. No.: 15/873,885

(22) Filed: Jan. 17, 2018

(65) Prior Publication Data

US 2018/0269604 A1 Sep. 20, 2018

(30) Foreign Application Priority Data

Mar. 15, 2017 (KR) ..... 10-2017-0032735

(51) Int. Cl.
*H01R 9/05* (2006.01)
*H01R 13/66* (2006.01)
(Continued)

(52) U.S. Cl.
CPC ..... *H01R 9/05* (2013.01); *H01R 12/91* (2013.01); *H01R 13/6315* (2013.01);
(Continued)

(58) Field of Classification Search
CPC .... H01R 2103/00; H01R 24/40; H01R 24/50; H01R 13/6315; H01R 13/665; H01R 13/73; H01R 9/05; H01R 24/542
(Continued)

(56) References Cited

U.S. PATENT DOCUMENTS 2,902,666 A * 9/1959 Novajovsky ..... H01P 1/28 29/525
3,678,445 A * 7/1972 Brancaleone ..... H01R 13/6596 439/607.17
(Continued)

FOREIGN PATENT DOCUMENTS

KR 10-1234337 2/2013
KR 10-1311724 9/2013

OTHER PUBLICATIONS

KIPO, Office Action of KR 10-2017-0032735 dated May 2, 2017.

*Primary Examiner* — Gary F Paumen
(74) *Attorney, Agent, or Firm* — Brundidge & Stanger, P.C.

(57) ABSTRACT

Provided are a connector and a blind mating connector including the same. The connector in accordance with the present invention includes a hollow body formed by bending a metal plate that is manufactured by press-processing a raw plate, a dielectric part built in the body, a signal pin passing through the dielectric part, a plurality of contact parts extending from both ends of the body, respectively, with a slit therebetween, a connection part defined in the body and at which both side ends of the metal plate are met and coupled, and an extension contact part bent and extending from one end of the contact part in a direction opposite to an extension direction of the contact part to face the contact part.

9 Claims, 9 Drawing Sheets

(51) Int. Cl.

| | |
|---|---|
| ***H01R 13/73*** | (2006.01) |
| ***H01R 24/54*** | (2011.01) |
| ***H01R 103/00*** | (2006.01) |
| ***H01R 13/631*** | (2006.01) |
| ***H01R 12/91*** | (2011.01) |
| ***H01R 24/50*** | (2011.01) |

(52) U.S. Cl.
CPC ..... *H01R 13/665* (2013.01); *H01R 24/50* (2013.01); *H01R 24/542* (2013.01); *H01R 13/73* (2013.01); *H01R 2103/00* (2013.01)

(58) Field of Classification Search
USPC ..... 439/675, 249–252, 63, 581
See application file for complete search history.

(56) References Cited

U.S. PATENT DOCUMENTS 3,847,153 A * 11/1974 Weissman ..... A61B 18/14
219/233
5,330,371 A * 7/1994 Andrews ..... H01R 13/6582
439/579
5,445,542 A * 8/1995 Serizay ..... H01R 13/6582
439/607.17
5,879,177 A * 3/1999 Honma ..... H01R 13/6315
439/246

* cited by examiner

CONNECTOR AND BLIND MATING CONNECTOR INCLUDING THE SAME

CROSS-REFERENCE TO RELATED APPLICATIONS

This U.S. non-provisional patent application claims priority under 35 U.S.C. § 119 of Korean Patent Application No. 10-2017-0032735, filed on Mar. 15, 2017, the entire contents of which are hereby incorporated by reference.

TECHNICAL FIELD

The present invention disclosed herein relates to a blind mating connector and a connector used in the blind mating connector.

BACKGROUND ART

As illustrated in FIG. 1, a typical blind mating connector 5 includes a first fixing connector 2 fixed to a lower portion of a connector 1 and a second fixing connector 3 fixed to an upper portion of the connector 1. Since the connector 1 is built in the first fixing connector 2 and the second fixing connector 3, the connector 1 serves to electrically connect the first fixing connector 2 to the second fixing connector 3.

As illustrated in FIG. 1A, the connector capable of performing a joint movement is coupled to the first fixing connector 2 so that the first fixing connector 2 is connected to the second fixing connector 3 by using the connector 1. In virtue of the joint movement of the connector 1, although the second fixing connector 3 is not disposed on a straight line with the first fixing connector 2 in a vertical direction but misaligned by a predetermined distance from the straight line, the first fixing connector 2 and the second fixing connector 3 may be connected to each other through the connector 1.

In virtue of the above-described configuration, as illustrated in FIG. 1B, blind mating in which the first fixing connector 2 and the second fixing connector 3 are connected by the connector 1 is performed.

Both ends of the connector 1 have an elastic structure so that the connector 1 performs the joint movement. The typical connector 1 may be manufactured through a CNC process and may not have a small thickness due to characteristics of the CNC process.

In general, a plurality of slits 4 that are spaced a predetermined distance in a circumferential direction are defined in both ends of the connector 1 to apply elasticity to the typical connector 1 having a predetermined thickness.

However, when the plurality of slits 4 are defined in the connector 1 along a longitudinal direction thereof, although elasticity is applied to the connector 1, as ground is exposed to the outside through the slits 4, a RF signal is leaked to the outside.

The preferred embodiments described above should be considered in descriptive sense only and are not for purposes of limitation. It is evident, however, that many alternative modifications and variations will be apparent to those having skill in the art in light of the foregoing description.

PRIOR ART DOCUMENT

Patent Document (Patent document 1) KR 10-1060341 B1 (Aug. 23, 2011)

DISCLOSURE OF THE INVENTION

Technical Problem

The present invention provides a connector that is manufactured to have a relatively small thickness through a press process and thus have a minimized length of a slit that is necessary for applying elasticity and a blind mating connector including the same.

Technical Solution

In accordance with an embodiment of the present invention, a connector includes: a hollow body formed by bending a metal plate that is manufactured by press-processing a raw plate; a dielectric part built in the body; a signal pin passing through the dielectric part; a plurality of contact parts extending from both ends of the body, respectively, with a slits therebetween; a connection part defined in the body and at which both side edges of the metal plate meet and are coupled; and an extension contact part bent and extending from one end of each contact part in a direction opposite to an extension direction of the contact part to face the contact part.

A distance between the extension contact part and each contact part, which are disposed at one end of the body, may be different from that between the extension contact part and each contact part, which are disposed at the other end of the body.

The connection part may include: a protruding portion protruding from one side edge of the metal plate; and a groove portion having a shape corresponding to the protruding portion on the other side edge, which faces the one side edge, of the metal plate and insertedly coupled to the protruding portion.

The protruding portion may gradually increase in area along a protruding direction.

The protruding portion may be provided in plurality while being spaced a predetermined distance from each other, an auxiliary groove portion defined in one side edge of the metal plate between protruding portions adjacent to each other and having an area gradually decreasing in the protruding direction of the protruding portion may be further defined, the groove portion may be provided in plurality in correspondence to the protruding portion, and an auxiliary protruding portion may be provided on the other side edge of the metal plate between groove portions adjacent to each other in correspondence to the auxiliary groove portion.

An auxiliary groove portion may be defined in the protruding portion within a range in which the protruding portion is provided, and an auxiliary protruding portion corresponding to the auxiliary groove portion may be defined in the groove portion within a range in which the groove portion is defined.

The connector may further include a separator provided on both ends of the body so that the metal plate is separated from the raw plate, and the separator may be provided at a position to face the connection part in a diametric direction of the body.

A length of an imaginary arc defined by the contact parts adjacent to each other with the separator therebetween may be the same as that of an imaginary arc defined by the contact parts adjacent to each other with the connection part therebetween.

In accordance with another embodiment of the present invention, a blind mating connector includes: a connector; a first fixing connector coupled to one end of the connector in a joint movable manner; and a second fixing connector coupled to the other end of the connector in a joint movable manner. The connector includes: a hollow body formed by bending a metal plate that is manufactured by press-processing a raw plate; a dielectric part built in the body; a signal pin passing through the dielectric part; a plurality of contact parts extending from both ends of the body, respectively, with a slits therebetween; a connection part defined in the body and at which both side edges of the metal plate are met and coupled to each other; and an extension contact part bent and extending from one end of each contact part in a direction opposite to an extension direction of the contact part to face the contact part.

Advantageous Effects

In accordance with the present invention, following various effects may be realized.

First, the RF signal may be prevented from being leaked to the outside by minimizing the length of the slit.

Second, as the end of the connector is not in direct contact with the fixing connector, the fixing connector may be prevented from being damaged on the surface thereof and have the improved elasticity.

Third, when the connector is separated from the fixing connector, since one portion of both ends of the connector, which has an elastic force less than that of the other portion, is firstly separated, the fixing connector that is separated from the connector may be selected.

Fourth, as the connection part is provided to be able to closely contact, the RF signal may be prevented from being leaked to the outside.

Fifth, the bent metal plate may be prevented from being restored, and also, such an effect may be realized over whole connection parts.

Sixth, the RF signal may be prevented from being leaked to the outside through the separator.

MODE FOR CARRYING OUT THE INVENTION

Figure 1A:
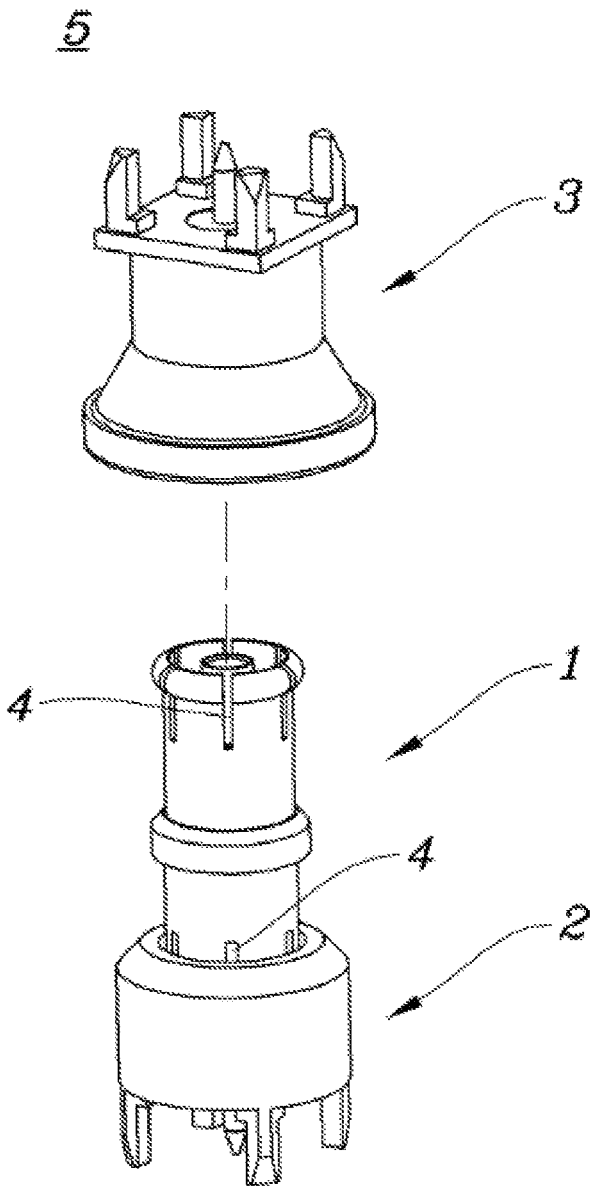
FIG. 1A is an exploded perspective view of a typical blind mating connector.
Figure 1B:
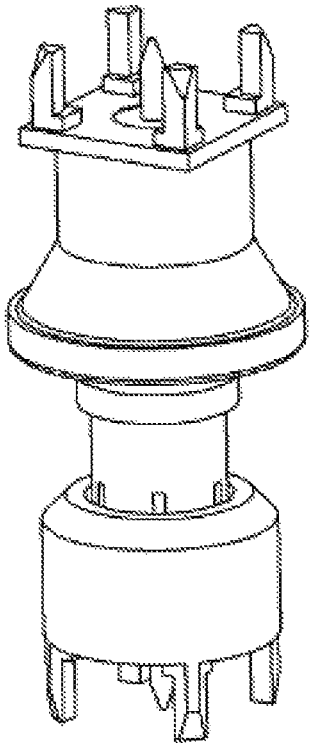
FIG. 1B is a perspective view of a typical blind mating connector.

The objects, characteristics and effects of the inventive concept will become apparent with the detailed descriptions of the preferred embodiment and the illustrations of related drawings as follows. In every possible case, like reference numerals are used for referring to the same or similar elements in the description and drawings. It will be understood that although the terms of first and second are used herein to describe various elements, these elements should not be limited by these terms. The terms are only used to distinguish one component from other components. Moreover, detailed descriptions related to well-known functions or configurations will be ruled out in order not to unnecessarily obscure subject matters of the present disclosure.

Hereinafter, preferred embodiments will be described in detail with reference to the accompanying drawings.

Figure 2:
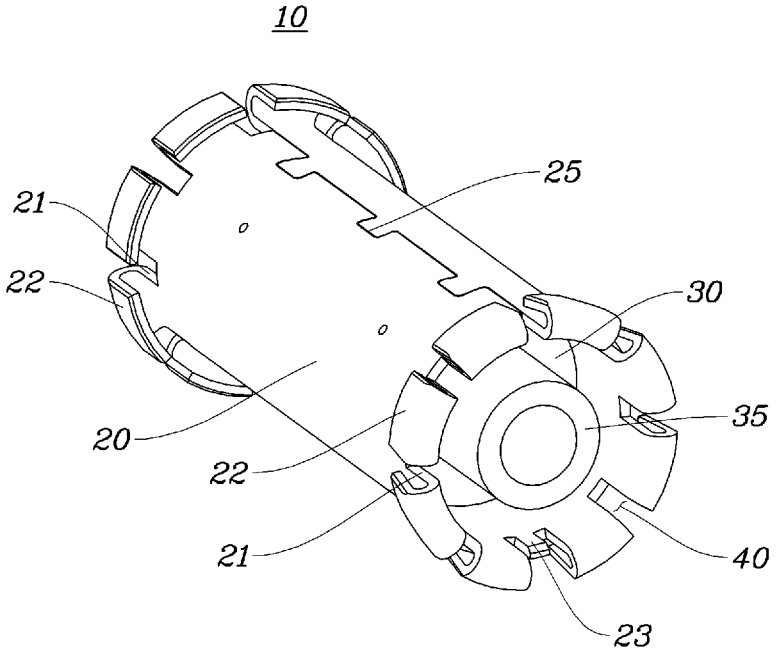
FIG. 2 is a perspective view of a connector in accordance with the present invention.

As illustrated in FIG. 2, a connector 10 in accordance with the present invention includes a body 20 that is formed in a cylindrical shape by bending a metal plate manufactured through a press process, a dielectric part 30 having a cylindrical shape and provided in an inner hollow of the body 20; a signal pin 35 passing through a central portion of the dielectric part 30, and a contact part 21 extending from both ends of the body 20 in a longitudinal direction. The contact part 21 is provided in plurality, and such a plurality of contact parts 21 are spaced a predetermined distance from each other with a slit 40 therebetween in a circumferential direction.

Figure 9:
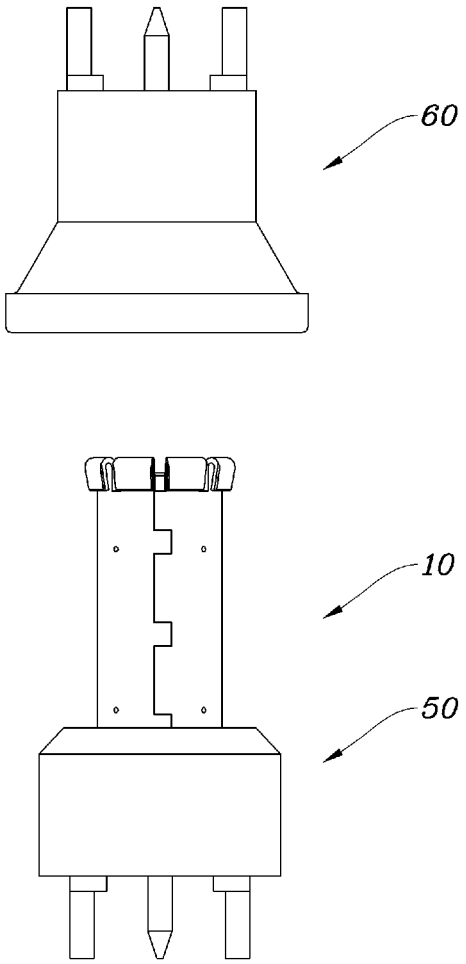
FIG. 9 is a configuration view of a blind mating connector in accordance with the present invention.

The signal pin 35 of the connector 10 is electrically connected to a signal pin provided on the first and second fixing connectors 50 and 60 (refer to FIG. 9) to transmit a RF signal, and the body 20 servers as a ground to prevent the RF signal from being leaked.

To this end, desirably, the signal pin 35 and the body 20 are made of metal, and the dielectric part 30 disposed between the signal pin 35 and the body 20 in a diametrical direction is made of a diametric material to transmit a RF signal.

Since the connector 10 may have a thickness less than that of the connector manufactured through a CNC process when the connector 10 is made of a thin metal plate through a press process, as the slit 40 is unnecessarily lengthy, the slit 40 may be minimized in length, and as the slit 40 is minimized in length, the external leakage of the RF signal may be minimized.

Since the body 20 is formed by bending a metal plate manufactured through a press process into a cylindrical shape, a connection part 25 is provided on both ends of the body 20 in a width direction, and the connection part 25 is desirably fixed by a method such as a laser welding to prevent both ends of the metal plate from being separated.

Since the connector 10 has an end that is not smoothly processed when manufactured through a press process in comparison with when manufactured through a CNC process, the first and second fixing connectors 50 and 60, to which the end of the connector 10 contacts when the connector 10 is coupled to or separated form the first and second fixing connectors 50 and 60 (refer to FIG. 9), may be easily damaged. When such a damage is repeated, the connector 10 may not be coupled to or separated from the first and second fixing connectors 50 and 60.

To solve the above-described limitation, an extension contact part 22 extending from one end of the contact part 21 in a direction opposite to an extension direction of the contact part 21 to fact the contact part 21 is provided.

Since the extension contact part 22 is bent from an end of the contact part 21 extending from the body 20 and extends in a direction opposite to the extension direction of the contact part 21, when the first and second fixing connectors 50 and 60 are coupled to the connector 10, an outer surface of the extension contact part 22 contacts the first and second fixing connectors 50 and 60.

Also, since the extension contact part 22 is spaced a predetermined distance in a diametric direction of the contact part 21 and the body 20, when an external force is applied to the extension contact part 22, the extension contact part 22 is pushed to be adjacent to the contact part 21, and, when the external force is removed, the extension contact part 22 is restored while being spaced apart from the contact part 21. That is, the elasticity is applied in virtue of a structure of the contact part 21 and the extension contact part 22.

As described above, in accordance with the present invention, the end of the connector 10 is prevented from directly contacting the first and second fixing connectors 50 and 60, the surface of the first and second fixing connectors 50 and 60 may be prevented from being damaged, and the elastic force may be enhanced.

Figure 3:
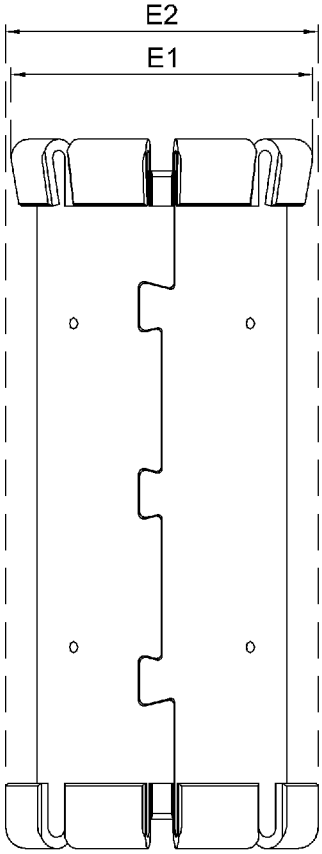
FIGS. 3 to 6 are plan views of a connector in accordance with the present invention.

Meanwhile, as illustrated in FIG. 3, an external diameter E1 including the body 20 and the extension contact part 22, which are disposed one end of the connector 10 may be less than an external diameter E2 including the body 20 and the extension contact part 22, which are disposed the other end of the connector 10. That is, the extension contact part 22 disposed on one end of the body 20 may have a degree of protrusion in the diametric direction of the body 20, which is less than that of the extension contact part 22 disposed on the other end of the body 20 in the diametric direction of the body 20, so that the one end and the other end of the connector 10 have different elastic forces.

Accordingly, when the connector 10 is separated from the first and second fixing connectors 50 and 60, since the end having the degree of protrusion less than the other among the one end or the other end is firstly separated, one of the first and second fixing connectors 50 and 60, which is separated from the connector 10, may be selected. That is, as an elastic force of the connector 10, which is applied to the second fixing connector 60, is less than an elastic force of the connector 10, which is applied to the first fixing connector 50, the second fixing connector 60 may be controlled to be firstly separated.

Figure 7:
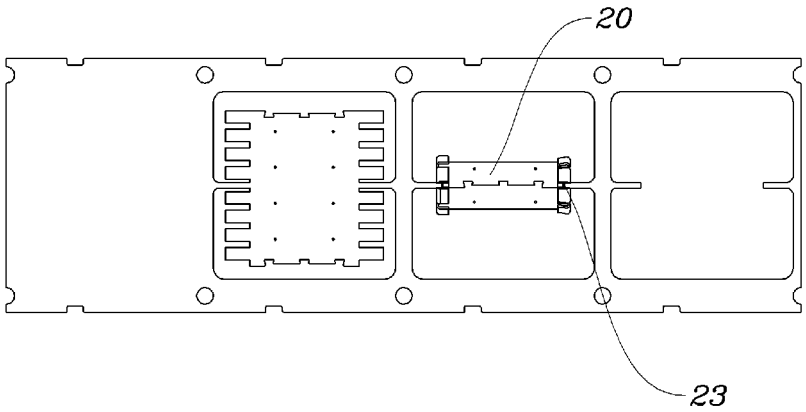
FIG. 7 is a view for explaining a process of manufacturing a connector in accordance with the present invention.

As illustrated in FIG. 7, a thin metal plate, which is a raw material, is press-processed to manufacture a metal plate in which an unfolded shape of the connector 10 is defined. Such a metal plate is bending-processed to manufacture the body 20 having a schematically cylindrical shape. In the bending process, the connection part 25 at which both sides of the metal plate meet is formed, and, when the both sides of the metal plate are not in close contact and spaced apart from each other at the connection part 25, a signal is leaked through the spaced gap.

Figure 4:
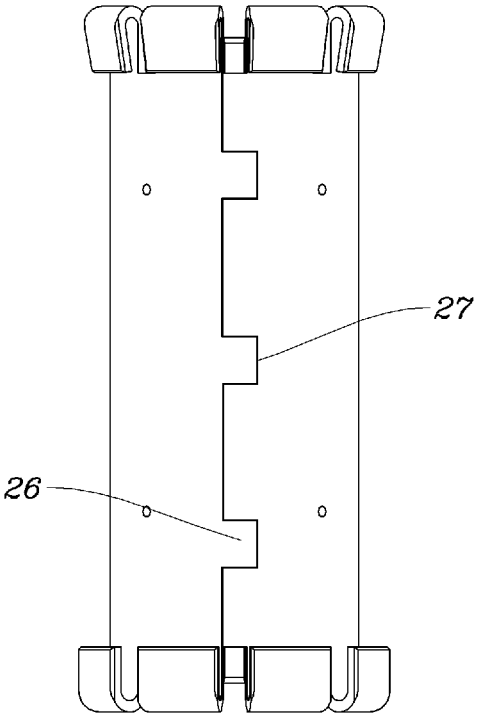

As illustrated in FIG. 4, the present invention solves the above-described limitation that may be generated from the connection part 25 by configuration of the connection part 25. That is, the connection part 25 includes a protruding portion 26 protruding from one side edge of the metal plate and a groove portion 27 having a shape corresponding to the protruding portion 26 and disposed on the other edge of the metal plate, which faces the one edge of the metal plate. That is, as the protruding portion 26 is insertedly coupled to the groove portion 27, the above-described limitation is solved.

As described above, since the protruding portion 26 is inserted into the groove portion 27 to increase a contact surface area of the both ends of the metal plate, the connection part 25 may be tightly sealed through the protruding portion 26 and the groove portion 27 to prevent a gap from being generated and thus prevent a signal from being leaked to the outside.

Figure 5:
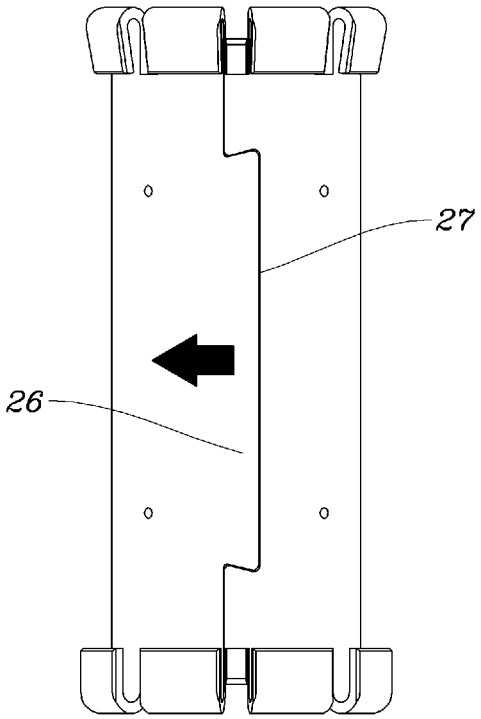

As illustrated in FIG. 5, the protruding portion 26 may have an area that gradually increases in a protruding direction. As the protruding portion 26 has the area that gradually increases in the protruding direction, although a restoration force is applied to the metal plate, the protruding portion 26 is caught by the groove portion 27 to prevent the metal plate from being restored.

The protruding portion 26 may have various shapes depending on selection of a designer as long as the shape gradually increases in area in a protruding direction to prevent the metal plate from being restored, e.g., elliptical and circular shape in addition to a trapezoidal shape in FIG. 5.

Figure 6:
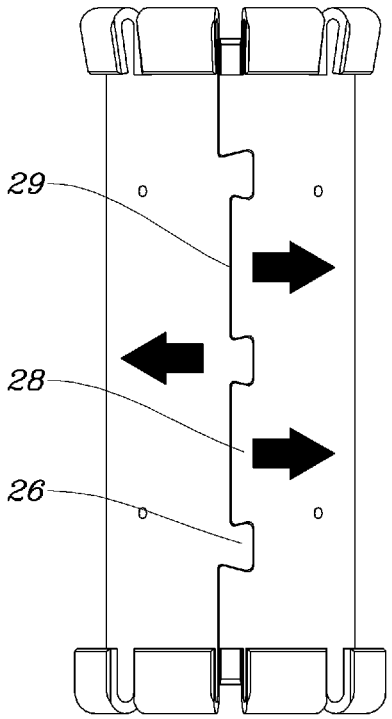

As illustrated in FIG. 6, a plurality of protruding portions 26 may be provided to be spaced a predetermined distance from each other on one side edge of the metal plate, and an auxiliary groove portion 29 that gradually decreases in area in the protruding direction of the protruding portion 26 may be defined between the plurality of protruding portions 26. Also, groove portions 27 defined in the other edge of the metal plate may be defined in a position corresponding to the plurality of protruding portions 26, respectively, and an auxiliary protruding portion 28 corresponding to the above-described auxiliary groove portion 29 may be defined between the groove portions 27 adjacent to each other.

As the auxiliary protruding portion 28 and the auxiliary groove portion 29 are defined, the metal plate may be prevented from being restored over the whole connection parts 25.

FIG. 7 is a view for explaining a process of manufacturing the body 20 constituting the connector of the present invention by using a press process. FIG. 7 shows, sequentially from a left side, a raw plate before a press process, a metal plate after the press process, the body 20 formed by bending the metal plate, and the metal plate from which the body 20 is separated.

Figure 8:
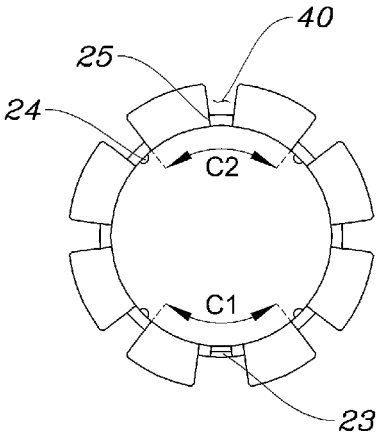
FIG. 8 is a schematic side view of a connector in accordance with the present invention.

As illustrated in FIGS. 7 and 8, since a separator 23 that is remained when the metal plate is separated from the raw plate is formed on both ends of the body 20 while being fixed during the press process, a RF signal may be leaked to the outside through the separator 23.

In accordance with the present invention, as the separator 23 is formed at a position facing a position at which the connection part 25 is formed in the diametric direction of the body 20, and a length C2 of an imaginary arc defined by contact parts 21 adjacent to each other with the connection part 25 therebetween is the same as a length C1 of an imaginary arc defined by the contact parts 21 adjacent to each other with the separator 23 therebetween, the above-described limitation is solved.

As illustrated in FIG. 8, the body 20 may include a fixing projection protruding from an inner wall of the body 20, and such a fixing projection 24 serves to fix the dielectric part 30 inserted into the body 20.

The present inventor performed an experiment for checking a degree of leakage of a RF signal by using the connector in accordance with the present invention. Table. 1 below shows results obtained from the experiment.

A is an experimental result obtained from a typical connector manufactured through a CNC processing, B is an experimental result obtained from a typical connector manufactured through a press processing, and C is an experimental result obtained from the connector manufactured through a press processing in accordance with the present invention.

TABLE 1

| Frequency | A | B | C |
|---|---|---|---|
| 3 Ghz | 91 dBc | 67 dBc | 106 dBc |
| 6 Ghz | 78 dBc | 77 dBc | 92 dBc |

A dBc value shows that as the value increases, RF signal leakage decreases. As shown in Table 1, B is greater than A in terms of RF signal leakage, and C is less than A and B in terms of RF signal leakage.

Meanwhile, the blind mating connector including the connector in accordance with the present invention includes the above-described connector 10 and the first and second fixing connectors 50 and 60, which are coupled to the connector 10 in a joint movable manner. The first fixing connector 50 is coupled to one end of the connector 10, and the second fixing connector 60 is coupled to the other end of the connector 10.

Here, as the signal pin 35 of the connector 10 is electrically connected to the signal pin of each of the first and second fixing connectors 50 and 60, the RF signal is transmitted, and the body 20 is electrically connected to the ground of each of the first and second fixing connectors 50 and 60. Description regarding the connector 10 that is a main portion of the present invention will be replaced by the above description.

Although the exemplary embodiments of the present invention have been described, it is understood that the present invention should not be limited to these exemplary embodiments but various changes and modifications can be made by one ordinary skilled in the art within the spirit and scope of the connector and the blind mating connector including the same in accordance with the present invention.

Hence, the real protective scope of the present invention shall be determined by the technical scope of the accompanying claims.

The invention claimed is:

1. A connector comprising:

a hollow body formed by bending a metal plate that is manufactured by press-processing a raw plate;

a dielectric part built in the body;

a signal pin passing through the dielectric part;

a plurality of contact parts extending from both ends of the body, respectively, with slits therebetween;

a connection part defined in the body and at which both side edges of the metal plate meet and are coupled to each other; and an extension contact part bent and extending from one end of each contact part in a direction opposite to an extension direction of the contact part to face the contact part.

2. The connector of claim 1, wherein a distance between the extension contact part and the each contact part, which are disposed at one end of the body, is different from that between the extension contact part and the each contact part, which are disposed at the other end of the body.

3. The connector of claim 1, wherein the connection part comprises:

a protruding portion protruding from one side edge of the metal plate; and a groove portion defined in the other side edge, which faces the one side edge, of the metal plate to have a shape corresponding to the protruding portion and insertedly coupled to the protruding portion.

4. The connector of claim 3, wherein the protruding portion gradually increases in area along a protruding direction.

5. The connector of claim 4, wherein the protruding portion is provided in plurality while being spaced a predetermined distance from each other, an auxiliary groove portion defined in one side edge of the metal plate between protruding portions adjacent to each other and having an area gradually decreasing in the protruding direction of the protruding portion is further defined, the groove portion is provided in plurality in correspondence to the protruding portion, and an auxiliary protruding portion is provided on the other side edge of the metal plate between groove portions adjacent to each other in correspondence to the auxiliary groove portion.

6. The connector of claim 4, wherein an auxiliary groove portion is defined in the protruding portion within a range in which the protruding portion is provided, and an auxiliary protruding portion corresponding to the auxiliary groove portion is provided in the groove portion within a range in which the groove portion is defined.

7. The connector of claim 1, further comprising a separator provided on each end of the body so that the metal plate is separated from the raw plate, and each separator is provided at a position to face the connection part in a circumferential direction of the body.

8. The connector of claim 7, wherein a length of an imaginary arc defined by the contact parts adjacent to each other with the separator therebetween is the same as that of an imaginary arc defined by the contact parts adjacent to each other with one end of the connection part therebetween.

9. A blind mating connector comprising:

a connector;

a first fixing connector coupled to one end of the connector in a joint movable manner; and a second fixing connector coupled to the other end of the connector in a joint movable manner, wherein the connector comprises:

a hollow body formed by bending a metal plate that is manufactured by press-processing a raw plate;

a dielectric part built in the body;

a signal pin passing through the dielectric part;

a plurality of contact parts extending from both ends of the body, respectively, with slits therebetween;

a connection part defined in the body and at which both side edges of the metal plate meet and are coupled to each other; and an extension contact part bent and extending from one end of each contact part in a direction opposite to an extension direction of the contact part to face the contact part.

* * * * *